US007647793B2

(12) United States Patent
Spielmann

(10) Patent No.: US 7,647,793 B2
(45) Date of Patent: Jan. 19, 2010

(54) DEVICE FOR KNITTING REVERSE AND FACE STITCHES ON A COMMON NEEDLE BED

(75) Inventor: Anton Percy Spielmann, Chemin du Port-de-Bellerive 3, 1245 Collonge-Bellerive (CH)

(73) Assignees: Anton Percy Spielmann, Collonge-Bellerive (CH); William Steven Spielmann, Collonge-Bellerive (CH)

( * ) Notice: Subject to any disclaimer, the term of this patent is extended or adjusted under 35 U.S.C. 154(b) by 30 days.

(21) Appl. No.: 12/065,169

(22) PCT Filed: Aug. 23, 2006

(86) PCT No.: PCT/CH2006/000457

§ 371 (c)(1),
(2), (4) Date: Feb. 28, 2008

(87) PCT Pub. No.: WO2007/025400

PCT Pub. Date: Mar. 8, 2007

(65) Prior Publication Data

US 2009/0126409 A1 May 21, 2009

(30) Foreign Application Priority Data

Aug. 29, 2005 (EP) ..... 05405499

(51) Int. Cl.
*D04B 35/06* (2006.01)

(52) U.S. Cl. ..... 66/120

(58) Field of Classification Search ..... 66/116–124
See application file for complete search history.

(56) References Cited

U.S. PATENT DOCUMENTS 1,385,929 A * 7/1921 Scott ..... 66/13

(Continued)

FOREIGN PATENT DOCUMENTS

DE 2647185 A * 5/1978 ..... 66/120

(Continued)

OTHER PUBLICATIONS

International Search Report of PCT/CH2006/000457, date of mailing Dec. 29, 2006.

(Continued)

*Primary Examiner*—Danny Worrell
(74) *Attorney, Agent, or Firm*—Westerman, Hattori, Daniels & Adrian, LLP

(57) ABSTRACT

The invention concerns a device comprising multiple parallel guide grooves (4) each of which receives a composite twin needle (1, 2) including two laterally open hooks (5, 6), arranged respectively through the first ends of two flat rods, one of which (1*a*-1*c*), is adjacent the base of the guide groove (4) and the other (2*a*-2*c*) is adjacent to the inner rod (1*a*-1*c*), means (10, 11) to cause the second end of said rods (1*a*-1*c*, 2*a*-2*c*) to be engaged with means controlling the knitting (12-15) of a face stitch, respectively, of a reverse stitch, the terminal edge of the rod (2*a*-2*c*) forming a gliding ramp (7). Each twin needle (1, 2) is associated with two adjacent jacks (18, 19), one (18) for forming a loop, alternately for retaining a stitch and the other (19) for releasing said loop.

12 Claims, 8 Drawing Sheets

U.S. PATENT DOCUMENTS

| | | | | |
|---|---|---|---|---|
| 4,197,721 | A * | 4/1980 | Hofmann et al. | 66/19 |
| 5,636,532 | A | 6/1997 | Shima et al. | |
| 6,609,398 | B2 * | 8/2003 | Plath | 66/120 |
| 6,895,784 | B2 * | 5/2005 | Hofmann | 66/120 |
| 2002/0194883 | A1 | 12/2002 | Spielmann et al. | |

FOREIGN PATENT DOCUMENTS

| | | | |
|---|---|---|---|
| EP | 0 672 770 | A | 9/1995 |
| EP | 1 127 970 | A | 8/2001 |
| EP | 1 184 498 | A | 3/2002 |
| EP | 1 295 976 | A | 3/2003 |

OTHER PUBLICATIONS

Written Opinion of the international Searching Authority dated Mar. 13, 2008, issued in corresponding International Application No. PCT/CH2006/000457.

* cited by examiner

O
32

18
Y
2

34

18
7
2

5
7

34
19d
32

32
2a
34

18
2a

32

34
19c 34
19
19d
19c
3

5
34

18
19a
19d
19e
18
21
20
22a
22b
18
19
XI
22c
22d

XI
3a
19c
19
21
2
4
19f
3
1

18
19
19e
19c
19f 19d
19a
19e
19f
19c
19
18
18a
24

XI-XI 18
19
20
22a
22b
22c
22d 22a
22b
22c
22d 22c
29
27
30
27a
p1

22d 22d
29d

DEVICE FOR KNITTING REVERSE AND FACE STITCHES ON A COMMON NEEDLE BED

The present invention relates to a device for selectively knitting reverse and face stitches using the needles of a common needle bed comprising a plurality of parallel tricks in which the needles slide.

In order selectively to knit face stitches and reverse stitches, the knitting yarn is transferred from the needles of one bed to those of the other bed. However, this can only be done if the needles of both beds intersect, which is normally the case.

If tubular knitted fabric is to be produced without sewing on a machine of this type, notably with the help of a rectilinear machine, it can only be done by knitting a single yarn alternating between one bed and the other, which makes the efficiency of such a solution unacceptable from an economical point of view.

U.S. Pat. No. 6,626,012 has proposed a solution to this problem, but the proposed solution is only capable of knitting face stitches.

It is an object of the present invention to overcome this limitation.

For this purpose the present invention relates to a device for selectively knitting reverse and face stitches on the needles of a common needle bed.

The proposed solution is therefore a valuable addition to the machine for knitting seamless tubular fabrics as proposed in the abovementioned patent.

The appended drawings illustrate in highly diagrammatic form and by way of example an embodiment of the device of the present invention.

Figure 7:
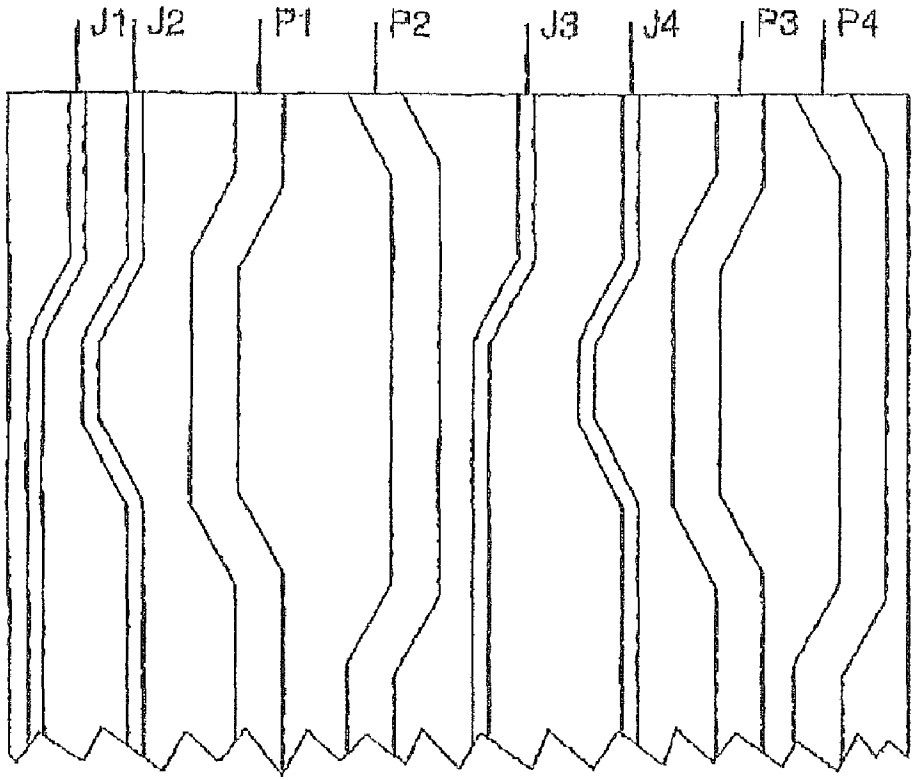
Figure 4:
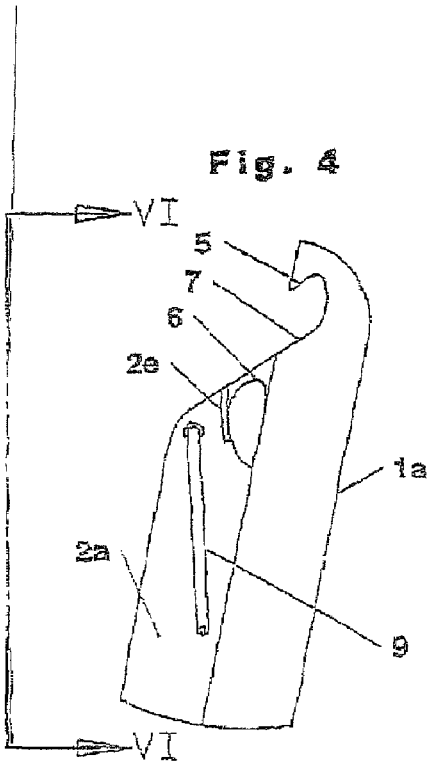
FIG. 4 is an enlarged partial view of IV-IV as marked in FIG. 3.
Figure 4A:
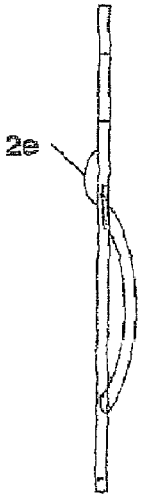
Figure 6:
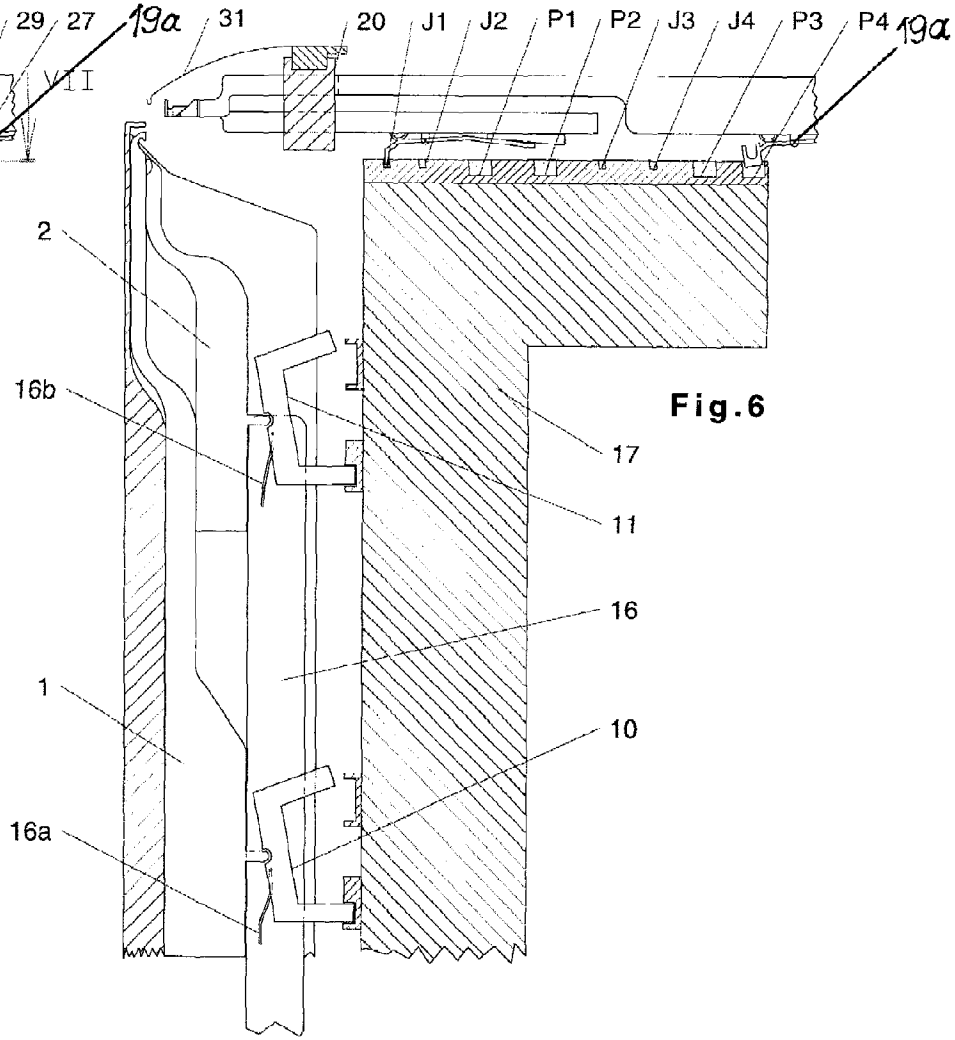
Figure 5:
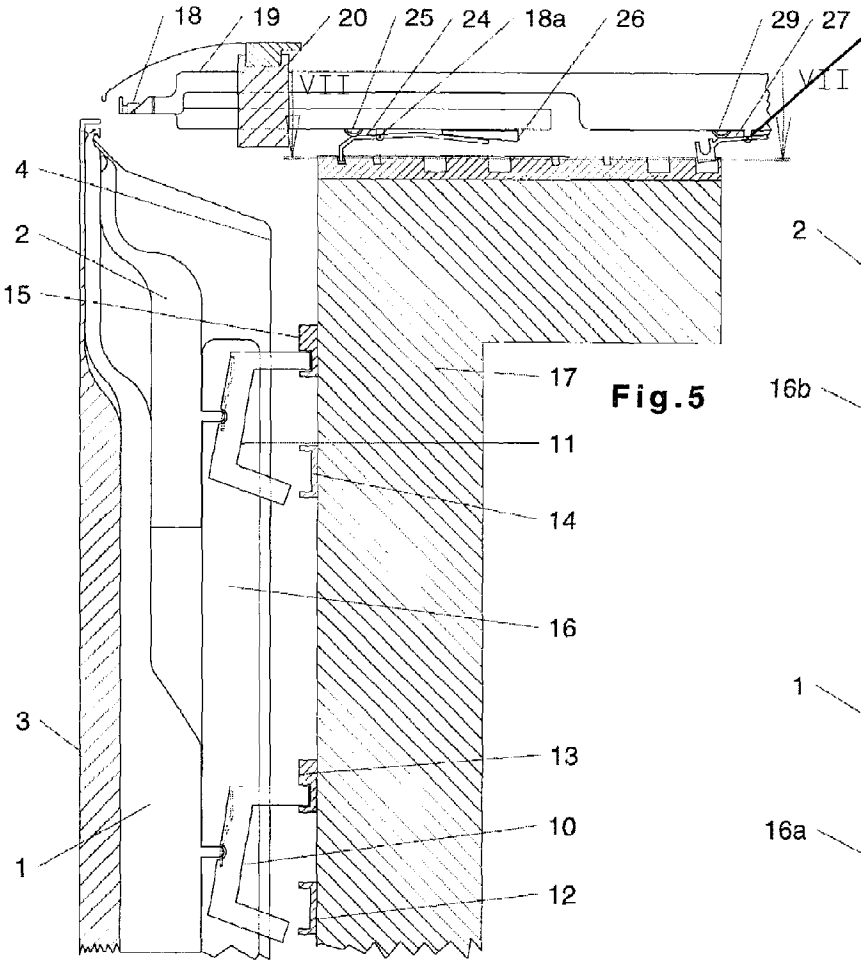
Figures 10, 18, 18A:
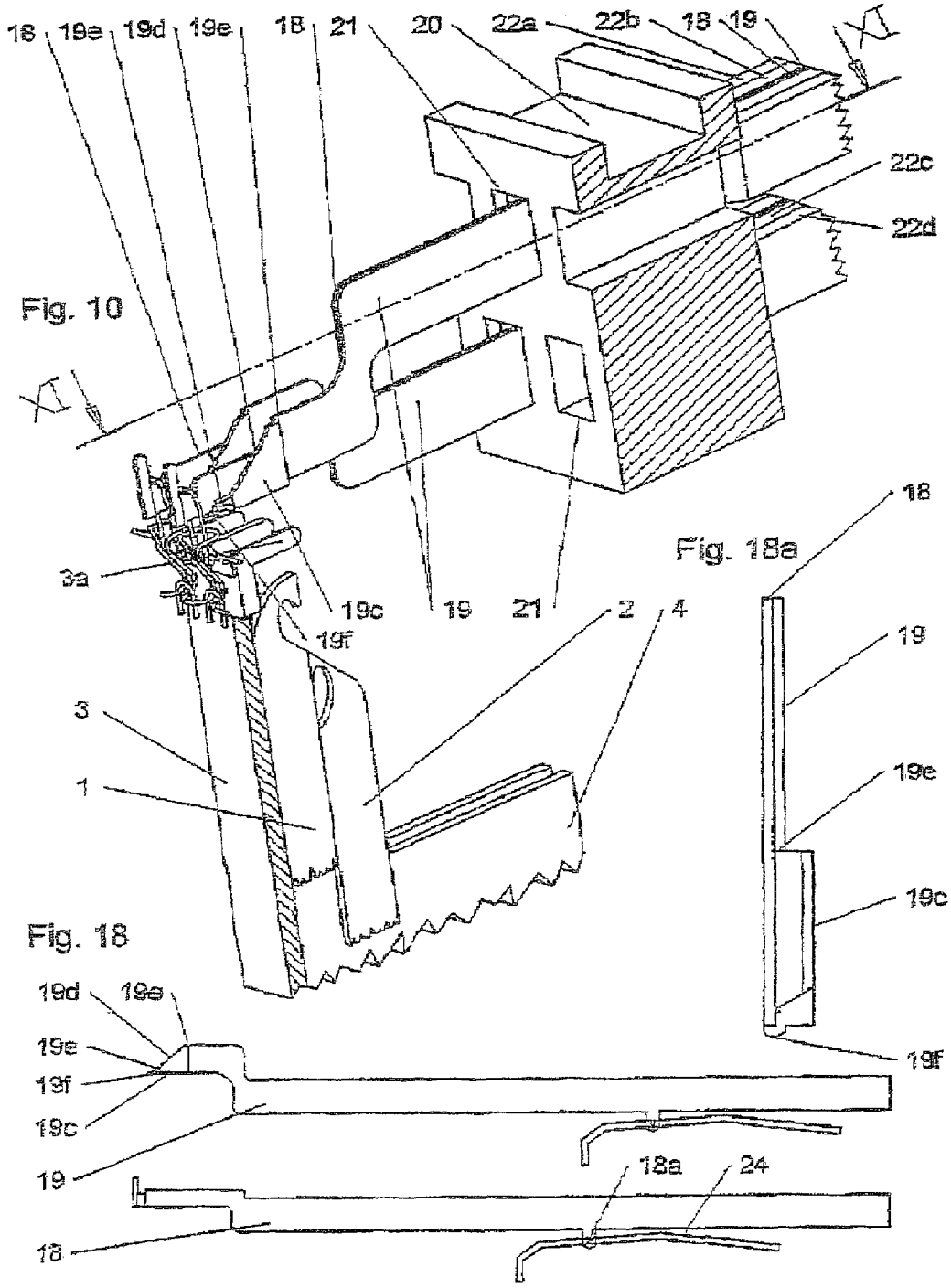
Figure 11:
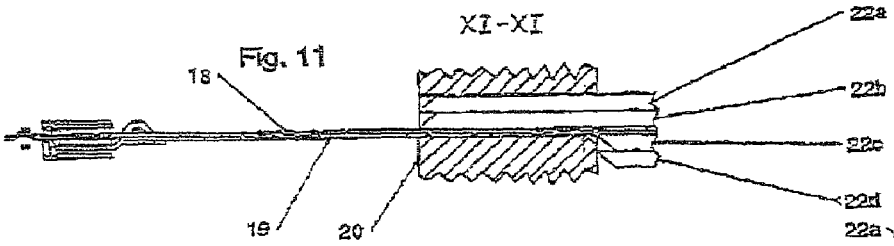
Figure 12:
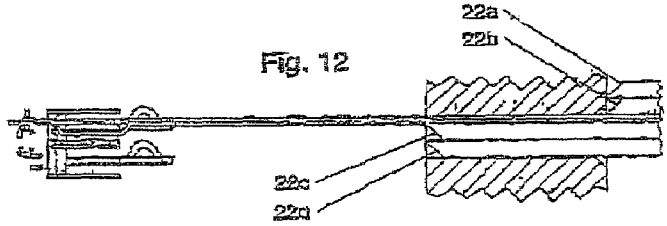
Figure 13:
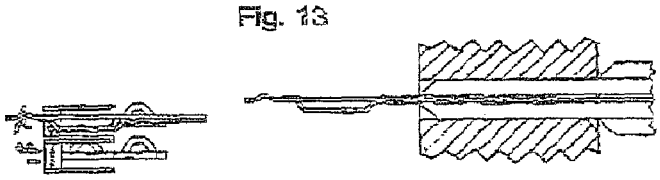
Figure 14A:
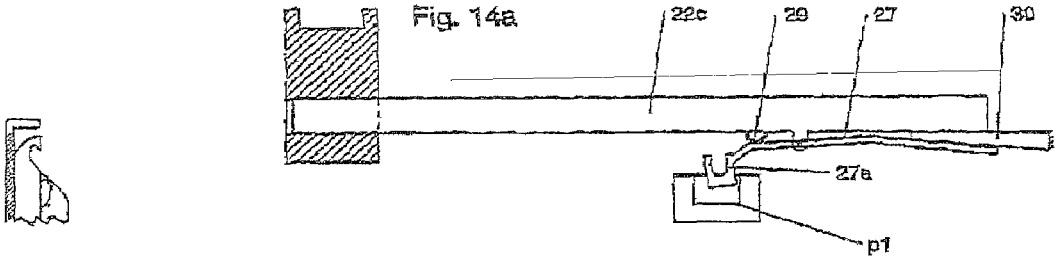
Figure 14B:
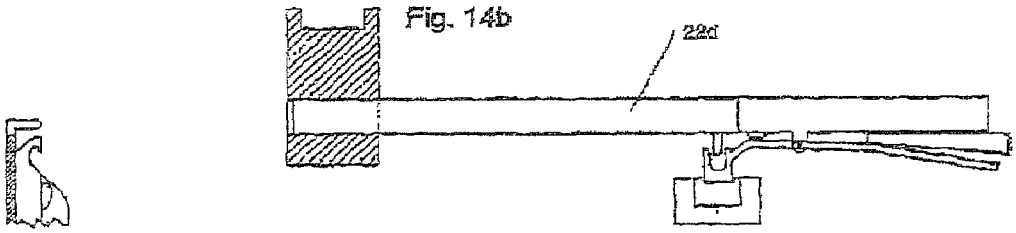
Figure 14C:
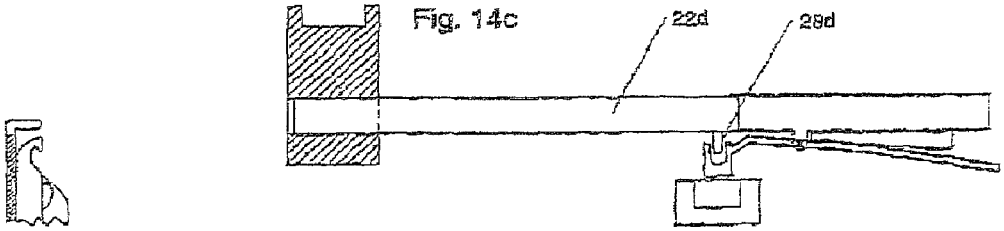
Figure 15A:
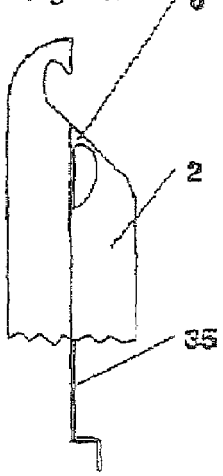
Figure 16A:
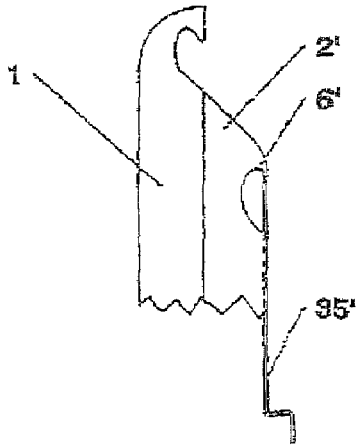
Figure 17A:
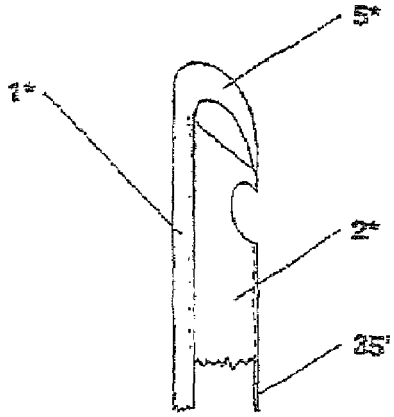
Figure 15B:
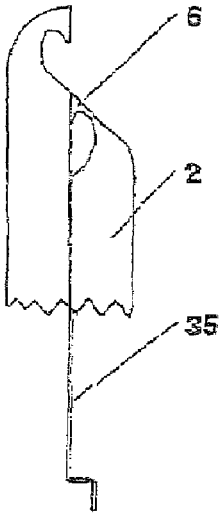
Figure 16B:
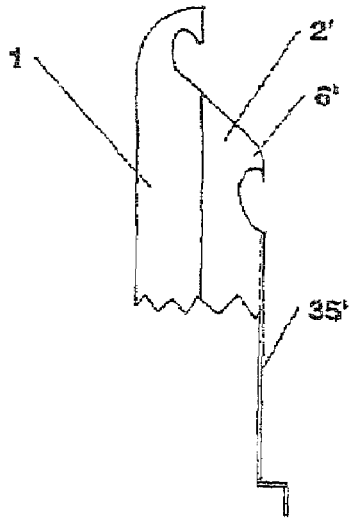
Figure 17B:
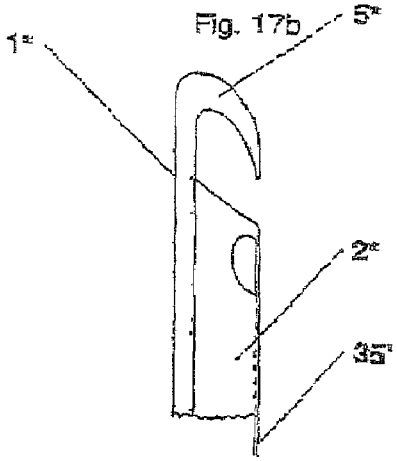

FIG. 4*a* is a view of FIG. 4 from the left;

FIG. 5 is a cross section through this device viewed at right angles to the bed in a first knitting position;

FIG. 6 is a view similar to FIG. 5 in a second knitting position;

FIG. 7 is a view on VII-VII as marked in FIG. 5;

FIGS. 8*a*-8*e* show the steps of forming a reverse stitch;

FIGS. 9*a*-9*l* show the steps of forming a face stitch;

FIG. 10 is an enlarged partial perspective view of FIG. 5;

FIG. 11 is a cross section on the line marked XI-XI in FIG. 10;

FIGS. 12 and 13 are views similar to FIG. 11 in two other positions;

FIGS. 14*a*, 14*b* and 14*c* are detail views from FIG. 5;

FIGS. 15*a*, 15*b* show a first variant of a knitting needle according to the invention;

FIGS. 16*a*, 16*b* show a second variant of a knitting needle;

FIGS. 17*a*, 17*b* show a third variant of a knitting needle;

FIG. 18 is a side elevation of two elements from FIG. 10; and

FIG. 18*a* is an enlarged end view of the front ends of the same two elements from FIG. 10.

Figure 3:
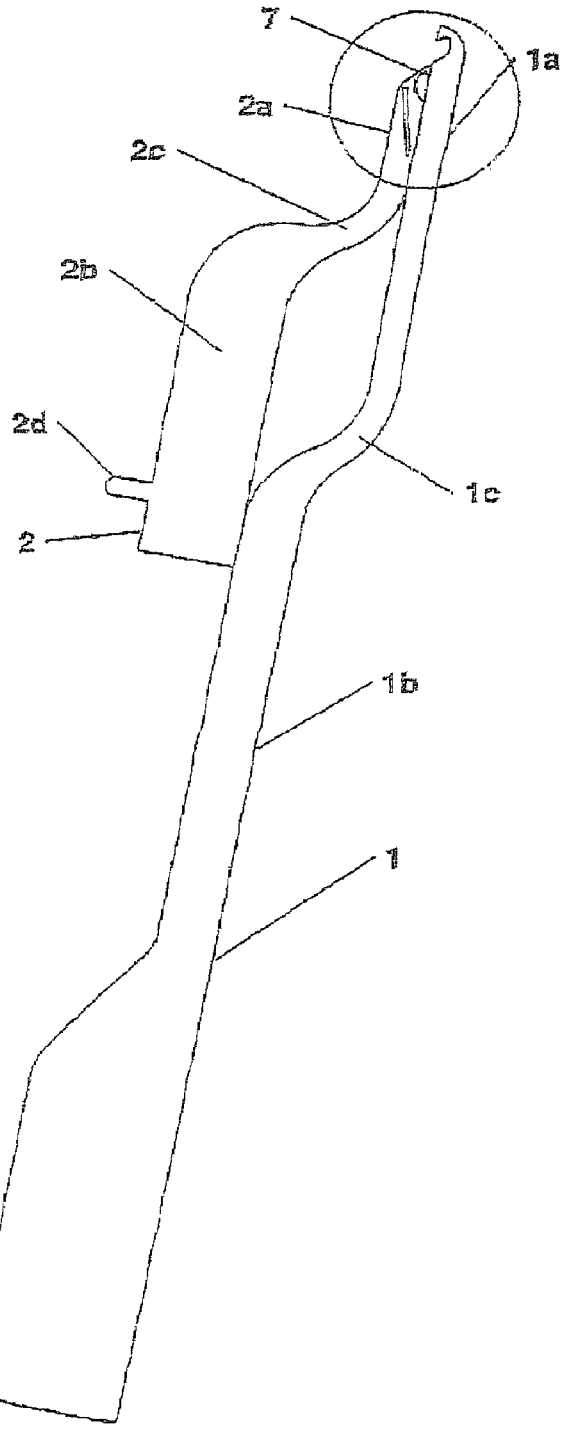
FIG. 3 is a side elevation of a knitting needle for this device.

FIGS. 3 and 4 show a composite double needle belonging to the device for knitting face stitches and reverse stitches selectively. This double needle comprises a first needle 1 and a second needle 2. These two needles 1 and 2 are elongate and are formed through two flat stems mounted coplanar in one of the usual parallel tricks 4 of a bed 3 of a knitting machine as illustrated in FIG. 5. The stem of the needle 1 is mounted in the bottom of the trick 4 and is the inner stem, while the stem of the second needle 2 which slides on the stem of the first needle 1 is the outer stem. In the case of the present invention, the tricks are however deeper than normal because they have to guide the double needle.

The upper end or first end of each needle stem 1, 2 ends in a hook 5, 6, respectively. In the embodiment illustrated, the two hooks 5, 6 are face to face. When they are in the relative positions illustrated in FIG. 3, the base of the hook 5 of the inner stem forms, with the final edge of the first end of the outer stem 2, a slope 7 on which the loop can slide, as will be explained later.

On one of the faces of the needle stem 2, close to its first end, is a displacing element 9 for pushing the loop of yarn away from the stem of the needle, for a purpose which will be explained later. This displacing element 9 is formed by a spring wire, one end of which is fixed while its other end can pass into a hole made through the stem of the needle 2.

Each needle stem 1, 2 has two parallel parts 1*a*, 1*b* and 2*a*, 2*b*, respectively, connected by a dogleg 1*c*, 2*c* respectively. The purpose of this is to make the upper part of the needle bed thin enough to reduce the spacing between this needle bed and the parallel needle bed (which is not shown) when forming a tubular knit in order to keep the transition between the fabrics knitted on the two beds as nearly invisible as possible.

At their respective second ends, the stems 1, 2 each have a butt 1*d*, 2*d*, respectively, on each of which an activator 10, 11 respectively pivots in the plane of the trick 4. Each activator 10, 11 has two arms designed to engage alternately with two control cams 12, 13 and 14, 15 respectively of the needles 1, 2. These cams 12-15 are mounted on a carriage 17 connected to normal drive means (not shown) so that it can be moved in a direction perpendicular to the cutting plane of FIGS. 5 and 6. A selector 16, mounted so as to slide in the trick 4, has two cam grooves 16*a*, 16*b* (FIG. 6) each engaged with a pin projecting laterally from each of the activators 10, 11. The selector 16 is moved between its two positions illustrated in FIGS. 5 and 6 by a selection mechanism (not shown), thus placing the arms of the actuators alternately in engagement with the cams 13, 15 and 12, 14, respectively, depending on whether face or reverse stitches are to be knitted.

The knitting device according to the invention also comprises a pair of jacks (sinkers), one 18 of which is the main jack (loop holding sinkers) while the other 19 is the auxiliary jack (loop clearing sinker). This pair is formed of two adjacent strips. Each pair of 30 jacks is associated with each composite double needle 1, 2. The main jack 18 is adjacent to one of the two large faces of the double needle 1, 2 and passes to the right of the latter when viewing the needle bed 3 from the needle side. One of the two large faces of the 35 auxiliary jack 19 is placed against one of the large faces of the main jack 18 (FIG. 10). At its forward end, the auxiliary jack 19 has a part 19*c* which is separated from the adjacent face of the main jack 18 but still parallel to this adjacent face. At the same time, the width of the auxiliary jack 19 decreases toward its forward end, forming a slope 19*d*. At its forward end, the auxiliary jack 19 comes back into 5 contact with the adjacent face of the main jack 18. This parallel part 19*c* is connected both to the strip of the auxiliary jack 19 and to its forward end, by two parts 19*e* which are inclined relative to the plane of the strip. This part 19*c* of the auxiliary jack thus 10 forms a channel through which the inner needle 1 can pass, as will be seen later.

As can be seen more particularly in FIG. 18*a*, the forward end of the slope 19*d* of the auxiliary jack 19 also has a bearing element 19*f* bent at 90° to the plane of the strip forming the auxiliary jack 19 to come under the thickness of the strip of the main jack 18.

These jacks 18, 19 are mounted so as to slide at right angles to the direction of movement of the needles 1, 2, through a holder 20 which is mounted on the needle bed 3 and on which a yarn guide 31 is fixed.

As illustrated in FIGS. 10-13, each pair of jacks 18, 19 passes through a rectangular-section opening 21, the width of which corresponds to the distance between two composite double needles. This is why the rectangular-section openings 21 through which the jacks 18, 19 pass are distributed alternately in two rows, an upper and a lower, within the holder 20. The remaining unoccupied space between the thicknesses of the two jacks 18, 19 and the edges of the rectangular-section opening 21 parallel to these jacks 18, 19 is occupied by two of the four shims 22*a*, 22*b*, 22*c*, 22*d* which belong to each pair of jacks 18, 19. These shims can be moved between two positions, in one of which it is engaged in and in the other disengaged from the rectangular-section opening 21, thus allowing the three combinations illustrated in FIGS. 11, 12 and 13 respectively, which correspond to three positions of the jacks 18, 19 relative to the rectangular-section opening 21. These shims 22*a*-22*d* thus allow a loop to be transferred from one composite double needle to another in order to make decreases. This transfer takes place between the steps of FIGS. 9*j*-9*k*.

As illustrated in FIGS. 5 and 6, each jack 18, 19 has a pivot element 18*a*, 19*a*. The distance between the pivot elements 18*a*, 19*a* of the jacks of the upper row and the holder 20 is greater than between this same holder 20 and the pivot elements 18*a*, 18*b* of the jacks of the lower row. This is due to the fact that the jacks 18, 19 of the upper row are longer than those of the lower row. This difference in length is intended to prevent interference between adjacent pairs of jacks when the jacks are moved laterally by the shims 22*a*-22*d*.

A series of cams J1, J2, P1, P2, J3, J4, P3, P4 is laid out on a surface of the carriage 17, this surface being perpendicular to the needle bed 3, as illustrated in FIGS. 5-7. Cams J1, J2 are for sliding the jacks 18, 19 of the lower row and cams J3, J4 those of the upper row according to the type of stitch being knitted. Cams P1, P2 are for sliding the four shims 22*a*-22*d* of the lower row and cams P3, P4 the four shims 22*a*-22*d* of the upper row.

The selective connection between the jacks 18, 19 and the cams J1, J2, J3, J4, on the one hand and between the shims 22*a*-22*d* on the other is created by a series of see-saws 24, 27 respectively, only two of which 24 and 27 are illustrated to keep the drawing clear. Each of these see-saws 24, 27 has an element at one end capable of being selectively engaged or not in respective cam tracks J1, J2, J3, J4 for the jacks depending on whether or not the jack is to be moved to form the desired type of stitch. To selectively engage the see-saws 24 with the jacks 18, 19 with their respective cams, each see-saw is subjected on the one hand to the force of a return spring 25 which tends to engage it with the cam J1, J2, J3, J4 associated with the corresponding jack 18, 19, and on the other hand to an actuating member 26 in the form of a sliding wedge controlled by control means (not shown) in order to pivot it in opposition to the force of the return spring 25, depending on the type of stitch to be knitted.

The selective movement of the shims 22*a*-22*d* is based on the same principle as that of the jacks 18, 19. However, as shown in FIGS. 11-13, three possible movements with the aid of the four cams must be possible, whereas only two cams P1, P2 are designed to slide the four shims 22*a*-22*d* of the lower row and two cams P3, P4 the four shims 22*a*-22*d* of the upper row.

To solve this problem, one possible way is to fit a see-saw 27 on the two shims 22*b*, 22*c* adjacent to the jacks 18, 19. These see-saws 27 (FIGS. 14*a*-14*c*) are similar to the see-saws 24 connected to the jacks, but the width of their end designed to engage in the cam tracks of the respective cams P1-P4 extends across two adjacent shims 22*a*, 22*b* and 22*c*, 22*d* respectively. This end has a recess 27*a* designed to take one of the projections 28*a*, 28*d* connected to the shims 22*a*, 22*d* adjacent to the shims 22*b*, 22*c* respectively, on which the see-saws 27 are mounted.

As in the case of the see-saws 24 associated with the jacks 18, 19, these see-saws 27 are subjected on the one hand to the force of a return spring 29 which tends to place this see-saw 27 in engagement with that one of the cams P1-P4 to which it is linked, and on the other hand to an actuating member 30 controlled by control means (not shown) for pivoting it against the force of the return spring 29, according to the type of stitch to be knitted. Unlike the actuating member 26 of the jacks 18, 19, the actuating member 30 of the shims 22*a*-22*d* can occupy three positions which are illustrated by FIGS. 14*a*, 14*b* and 14*c* respectively. When the actuating member 30 is in the position shown in FIG. 14*a*, only shim 22*b* or shim 22*c* connected to a see-saw 27 is driven: shims 22*a* and 22*d* adjacent to shims 22*b* and 22*c* respectively are not driven because of the fact that the level of the recesses 27*a* at one of the ends of the see-saws 27 is now situated below the level of the projections 28*a*, 28*d*. When the actuating member 30 is in the position shown in FIG. 14*b*, the end of the see-saw 27 is still engaged in the track of one of the cams P1-P4 and the recess 27*a* is then in engagement with a projection 28*a* or 28*d*, such that in this position each cam P1-P4 controls the movement of two adjacent shims 22*a*-22*d* of the upper row or of the lower row. Consequently, between the position of the jacks 18, 19 shown in FIG. 11 and that shown in FIG. 12, the jacks have been moved by a distance corresponding to the distance between two adjacent composite double needles 1, 2 on the needle bed 3, so that the jack 18 can now transfer a loop from one composite double needle to another adjacent composite double needle, allowing a decrease to be made. It should be realized that this ability to decrease is obviously an important feature of the present invention, but that it is only a preferred feature, and that the invention per se relates to the formation of two types of stitches on the same needle bed, which will be explained below.

The knitting device of the present invention having now been described sufficiently to enable a person skilled in the art to see how its various component parts can be actuated, we will now explain the various mechanisms which make it possible, using this device, selectively to knit face and reverse stitches on a common needle bed.

Figure 1:
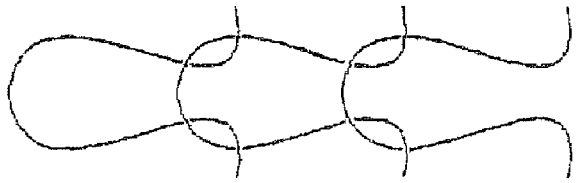
FIG. 1 is a view of a reverse stitch.
Figure 2:
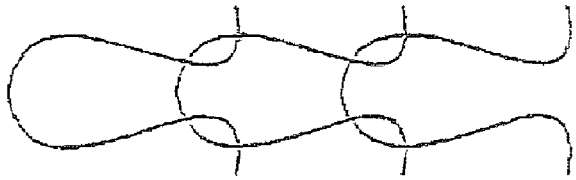
FIG. 2 is a view of a face stitch.
Figure 8C:
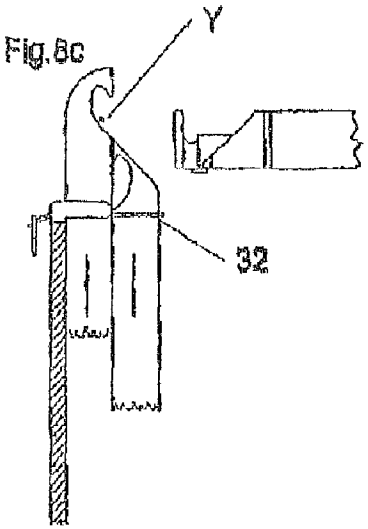
Figure 8B:
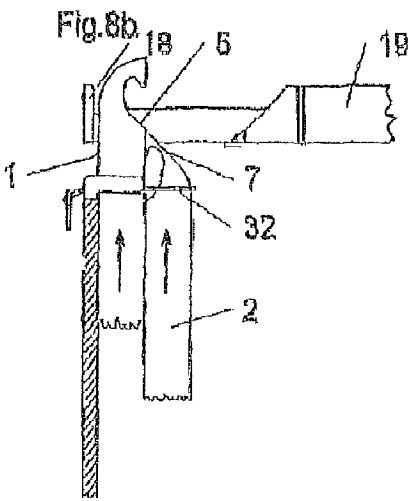
Figure 8E:
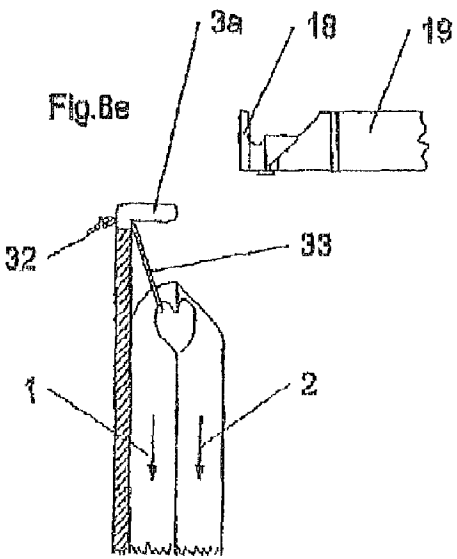
Figure 8A:
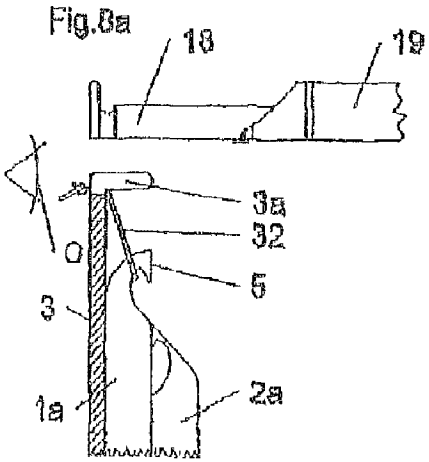
Figure 8D:
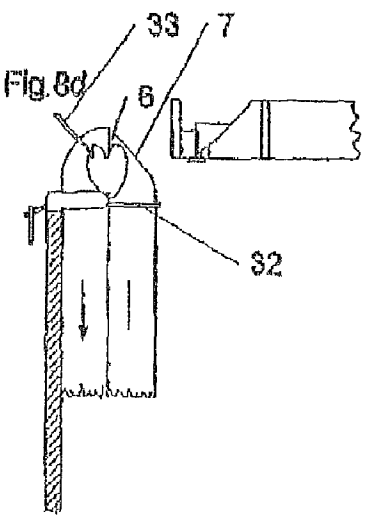

FIGS. 8*a*-8*e* show the steps of forming a reverse stitch as in FIG. 1, which shows what the observer marked O in FIG. 8*a* sees. FIG. 8*a* shows the old loop 32 held between the hook 5 of the inner needle 1*a* and the comb 3*a* formed at the upper edge of the needle bed. The jack 18 is in its advanced position toward the needle bed 3. In the next step (FIG. 8*b*) the two needles 1, 2 of the composite double needle have risen, causing the old loop 32 to slide down the slope 7 formed at the base of the hook 5 of the needle 1 and on the end of the needle 2, until it is on the stem 2*a* of the needle 2. The main jack remains in its advanced position and serves to prevent the old loop 32 rising with the needles 1, 2.

In the next step (FIG. 8*c*), the main jack 18 retreats and the yarn guide 31 places the yarn Y in the hook 5 of the inner needle 1. Next (FIG. 8*d*), the inner needle 1 descends until its hook 5 is in front of the hook 6 of the outer needle 2. Finally, both needles 1, 2 descend, pulling a loop 33 of yarn Y and causing the old loop 32 to ride up over the slope 7 of the outer needle 2. This loop grips the loop 33 and passes onto the other side of the needle bed 3 through the teeth of the comb 3*a* formed by the upper edge of the needle bed 3, as illustrated in FIG. 8*e*. The cycle described above can then repeat from the step of FIG. 8*a*. To knit a rib knit with one reverse stitch alternating with one face stitch, if two adjacent double needles 1, 2 are observed, one of these double needles and its associated jacks 18, 19 are operated through the sequences of FIGS. 9*a*-9*l* and during this time the other adjacent double needle 1, 2 and its associated jacks are operated through the sequences 8*a*-8*e*, the movement between 8*d* and 8*e* being delayed to coincide with phases 9*g*-9*j* of the other adjacent double needle 1, 2.

Figures 9A, 9B, 9C, 9D, 9E, 9F, 9G, 9H, 9I, 9J, 9K, 9L:
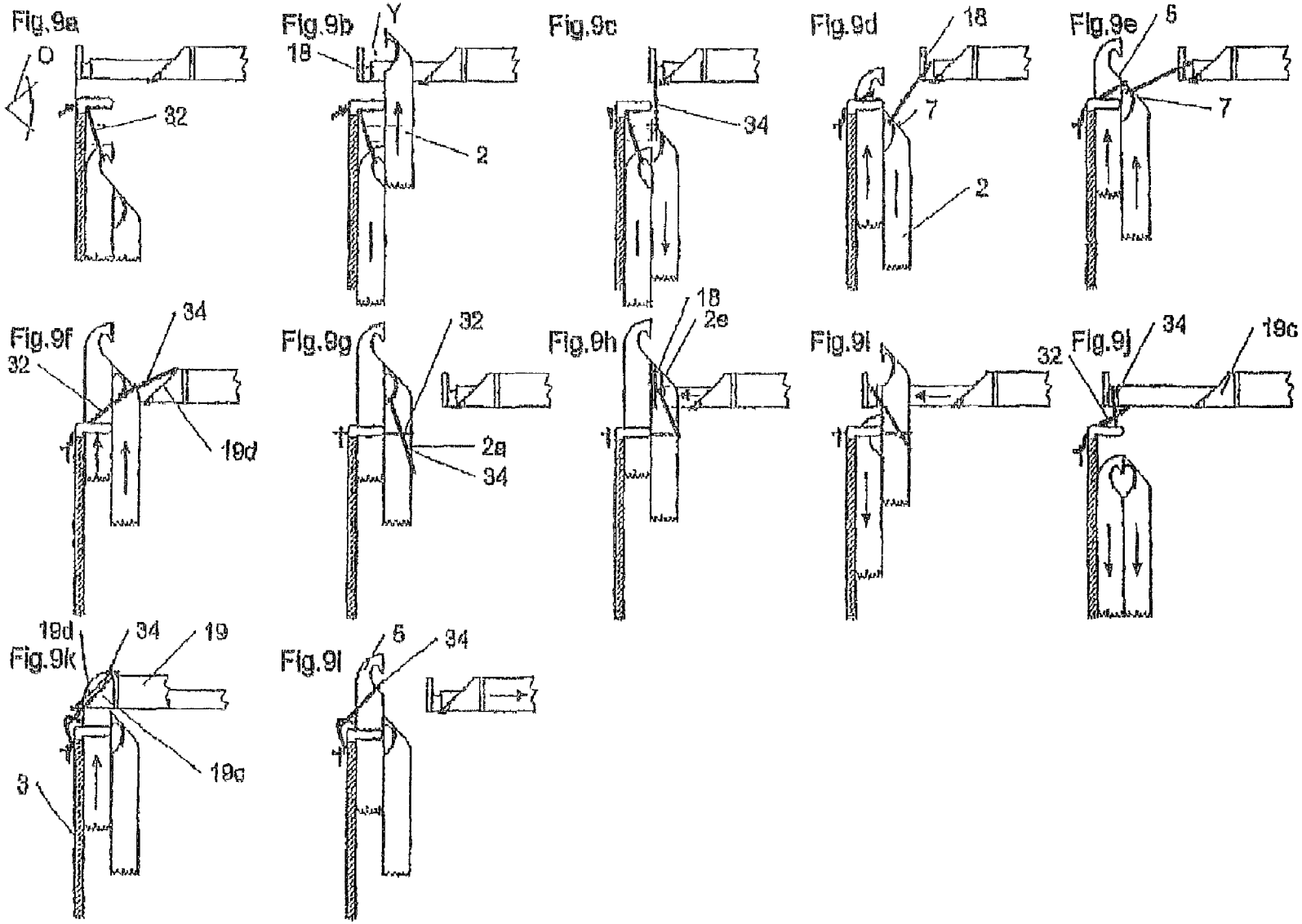

The formation of a face stitch will now be explained as viewed by the observer O in FIG. 9*a* with the help of FIGS. 9*a*-9*l*. The starting position shown in FIG. 9*a* is practically the same as for a reverse stitch. To begin, the outer needle 2 rises, the yarn Y is placed on the jack 18 which retreats and pulls the yarn Y into the hook 6. The outer needle 2 descends, pulling a loop of yarn 34 which is stretched between the needle and the main jack 18 (FIG. 9*c*). In the next step (FIG. 9*d*), the main jack 18 is moved toward the rear and pulls the loop 34 in the hook 6. The inner needle 1 rises until the base of the hook 5 is aligned with the loop-sliding slope 7 on the upper end of the needle 2. In the next step (FIG. 9*e*), both needles 1, 2 rise together. As the needles rise, the old loop 32 slides down that part of the hook 5 of the needle 1 which is in line with the loop-sliding slope 7, until it is completely off the hook 5. The double needle 1, 2 continues to rise until the old loop 32 catches the loop 34, after which the auxiliary jack 19 is advanced (FIG. 9*f*), which causes the loop of yarn 34 to slide up its ramp 19*d* and off the main jack 18. As a result, when it retreats, the auxiliary jack 19 (FIG. 9*g*) allows the old loop 32 to knock off the loop of yarn 34 that is to form the new loop against the stem 2*a* of the outer needle 2.

At the end of the upward movement of the double needle 1, 2, the main jack 18 is advanced toward the needle bed 3 between the outer needle 2 and the spacer element 8 and passes into the loop until the hook of the jack 18 closes the hook 6 and protects the loop during the descent of the hook 5 (FIG. 9*h*). The inner needle 1 then descends and the jack 18 advances (FIG. 9*i*), allowing the loop 34 to slide along the main jack 18. In the next step, the outer needle 2 moves back down (FIG. 9*j*). Said outer needle 2 has a protrusion 2*e* to move the loop 34 away and protect it from the hook 6. This descent of the needle 2 allows the old loop 32 to grip the new loop 34. Depending on whether the loops are to be transferred, the jacks will be moved laterally toward the adjacent needle. The auxiliary jack 19 will then advance toward the needle bed 3, causing the new loop 34 to slide along its slope 19*c* (FIG. 9*k*) and off the main jack 18 and the inner needle 1 moves up again, passing between the jacks 18 and 19 in the channel formed between the jacks 18, 19 by the part 19*c* of the auxiliary jack 19. As it moves away from the needle bed 3, the auxiliary jack allows the new loop 34 to slide along the slope 19*d* of the auxiliary jack 19 and be pulled by the old loop into the hook 5 of the inner needle 1 (FIG. 9*l*). The jacks 18, 19 move back into the starting position (FIG. 9*a*).

Several variants may be envisioned as regards both the composite needle and their control as well as the control of the jacks. For example, the traditional control of knitting needles using cams could be replaced by other known controls, such as a linear motor, for example, described in EP 1 061 168.

As far as the knitting needles are concerned, a number of variants have been shown. Those of FIGS. 15*a*, 15*b* correspond to the composite needle of FIGS. 3 and 4 to which a third element 35 has been added to close the hook 6 of the outer needle 2. This closing element 35 is controlled by a cam (not shown) on the carriage 17, like cams 12-15.

The variant shown in FIGS. 16*a*, 16*b* differs from the preceding variant in that the opening of the hook 6' of the outer needle 2' is not toward the inner needle 1 but opens on the opposite side. The opening of this hook 6' is also controlled by a closing element 35'.

Lastly, the variant shown in FIGS. 17*a*, 17*b* differs essentially from the preceding variant in the shape of the hook 5* of the inner needle 1*, in the width of which the outer needle 2* fits, so that the upper end of the outer needle 2* can close or open the hook 5* depending on its position relative to the inner needle 1*.

In still another variant, the pairs of jacks 18, 19, which occur alternately in two rows of openings 21 with a spacing between adjacent openings of one row offset by a half interval relative to the openings of the other row, could also be distributed on more than two rows of offset openings.

The invention claimed is:

1. A device for selectively knitting reverse and face stitches using needles of a common needle bed comprising a plurality of parallel tricks in which the needles slide, said device being characterized in that each of these tricks houses a composite double needle comprising two laterally open hooks formed respectively through first ends of two flat stems, wherein an inner stem is adjacent to a back face of the trick, and an outer stem is coplanar and adjacent to the inner stem, means for placing a second end of each of said stems selectively in engagement with two control means for knitting either a face stitch or a reverse stitch respectively, a final edge of the first end of the outer stem forming a slope for sliding a loop at an acute angle with its edge adjacent to the inner needle, and in that each double needle is associated with two adjacent sinkers, a first holding sinker for forming a loop or alternatively for retaining a loop, and a second sinker for clearing said loop, each of said sinkers associated with means for placing them selectively in engagement with control means.

2. The device as claimed in claim 1, in which the respective stems of the two needles of said composite double needle each comprise two parallel parts connected by a dogleg connecting portion and in that the needle bed comprises an upper part of reduced thickness to accommodate the upper part of the composite double needle, this needle bed ending in a comb to allow the passage of the loops of each needle.

3. The device as claimed in claim 1, in which the composite double needle comprises means for displacing a yarn loop during knitting in order to allow the first sinker to pass into this yarn loop during knitting.

4. The device as claimed in claim 1, in which said second sinker has a portion, adjacent to its forward end, that separates from the first sinker to allow the passage of one of the needles of the composite double needle.

5. The device as claimed in claim 1, in which said pairs of adjacent sinkers associated with the adjacent composite double needles are spaced out at equal intervals from each other and are distributed on at least two rows, the intervals separating the pairs of one row being offset by a half interval relative to the adjacent row.

6. The device as claimed in claim 2, in which said second sinker has a portion, adjacent to its forward end, that separates from the first sinker to allow the passage of one of the needles of the composite double needle.

7. The device as claimed in claim 3, in which said second sinker has a portion, adjacent to its forward end, that separates from the first sinker to allow the passage of one of the needles of the composite double needle.

8. The device as claimed in claim 2, in which said pairs of adjacent sinkers associated with the adjacent composite double needles are spaced out at equal intervals from each other and are distributed on at least two rows, the intervals separating the pairs of one row being offset by a half interval relative to the adjacent row.

9. The device as claimed in claim 3, in which said pairs of adjacent sinkers associated with the adjacent composite double needles are spaced out at equal intervals from each other and are distributed on at least two rows, the intervals separating the pairs of one row being offset by a half interval relative to the adjacent row.

10. The device as claimed in claim 4, in which said pairs of adjacent sinkers associated with the adjacent composite double needles are spaced out at equal intervals from each other and are distributed on at least two rows, the intervals separating the pairs of one row being offset by a half interval relative to the adjacent row.

11. The device as claimed in claim 6, in which said pairs of adjacent sinkers associated with the adjacent composite double needles are spaced out at equal intervals from each other and are distributed on at least two rows, the intervals separating the pairs of one row being offset by a half interval relative to the adjacent row.

12. The device as claimed in claim 7, in which said pairs of adjacent sinkers associated with the adjacent composite double needles are spaced out at equal intervals from each other and are distributed on at least two rows, the intervals separating the pairs of one row being offset by a half interval relative to the adjacent row.

* * * * *